US005448812A

United States Patent [19]

Wolf et al.

[11] Patent Number: 5,448,812

[45] Date of Patent: Sep. 12, 1995

[54] HEALD TRANSFER STATION HAVING LOCKS POSITIONED TO CONTROL MOVEMENT OF HEALDS

[75] Inventors: Markus Wolf, Sargans; Philipp Kuehne, Oberdorf, both of Switzerland

[73] Assignee: Stäbli AG, Horgen, Switzerland

[21] Appl. No.: 304,200

[22] Filed: Sep. 12, 1994

[30] Foreign Application Priority Data

Sep. 13, 1993 [CH] Switzerland ..... 02753/93

[51] Int. Cl.[6] ..... D03J 1/14

[52] U.S. Cl. ..... 28/205; 28/208

[58] Field of Search ..... 28/204, 205, 206, 207, 28/208

[56] References Cited

U.S. PATENT DOCUMENTS

| | | | |
|---|---|---|---|
| 4,525,906 | 7/1985 | Tovenrath et al. | 28/205 |
| 4,573,856 | 5/1986 | Meyer et al. | 28/208 X |
| 4,891,871 | 1/1990 | Tachibana et al. | 28/205 |
| 4,916,785 | 4/1990 | Tachibana et al. | 28/208 |
| 5,088,523 | 2/1992 | Bucher et al. | 28/205 X |
| 5,184,380 | 2/1993 | Benz et al. | 28/205 |
| 5,274,894 | 6/1994 | Wilhelm et al. | 28/208 X |
| 5,287,605 | 2/1994 | Badertscher | 28/207 |
| 5,323,518 | 6/1994 | Tachibana et al. | 28/207 |

FOREIGN PATENT DOCUMENTS 0496232 1/1993 European Pat. Off. .

OTHER PUBLICATIONS

"Automatic Drawing-in Equipment", Uster EMU, Zellweger Uster, Ltd., Switzerland, 8 pages, Jul. 1982.

Uster Delta, Zellweger Uster, 17 pages, Aug. 1989.

*Primary Examiner*—John J. Calvert

*Attorney, Agent, or Firm*—Burns, Doane, Swecker & Mathis

[57] ABSTRACT

The healds are distributed to carrier rails in a transfer station by heald holders forming part of a distribution station. A lock having two spaced controlled clamps a transfer member and a slide are provided for each carrier rail. The transfer member transports the healds from the heald holder through the first clamp adjacent to the latter into the space between the clamps where intermediate storage of the healds takes place. The transport of the healds through the second clamp takes place by means of the slide. Use for the working off of healds having closed end loops.

17 Claims, 6 Drawing Sheets

HEALD TRANSFER STATION HAVING LOCKS POSITIONED TO CONTROL MOVEMENT OF HEALDS

FIELD OF THE INVENTION

The present invention relates to a heald transfer apparatus, and more particularly to an apparatus for the selective transfer of healds from a distribution station of a warp-thread drawing-in machine to heald carrier rails, with a heald holder which forms part of the distribution station and on which the healds are held individually, and with a transfer station, including transfer members, which is assigned to the heald carrier rails and past which the heald holder is guided.

BACKGROUND OF THE INVENTION

The transfer of healds can be accomplished in different ways, depending on the type of healds used and whether the healds have open or closed end loops. When healds having open end loops are being worked off, such as, for example, in the warp-thread drawing-in machine designated USTER DELTA (USTER being a registered trademark of Zellweger Uster AG), the healds are transferred onto the heald carrier rails already mounted on the heald frames. Since it is sufficient, in this case, to position the heald frames in the warp-thread drawing-in machine and align them with the heald holders, the transfer is simple and requires no special measures.

During the working-off of healds having closed end loops, such as, for example, in the warp-thread drawing-in machine designated USTER EMU, the heald carrier rails are filled with healds outside the heald frames and are mounted on the heald frames only thereafter. The heald carrier rails therefore have to be positioned in the warp-thread drawing-in machine, specifically in such a way that the healds surrounding the carrier rails on all sides by means of the closed end loops can be displaced undisturbed on the carrier rails.

In the machine referred to as USTER EMU, the heald carrier rails are mounted on spaced holding bolts which are removed temporarily for the passage of a stack of a plurality of healds. A distribution station having a heald holder is not provided here, but the heald carrier rails project with one end freely towards the separating station. Apart from the fact that the holding bolts, to be pulled out by hand and then pushed in again, are highly adverse to automation, and that the risk of a heald build-up in front of the first holding bolt increases with the number of heald carrier rails arranged next to one another, the free ends of the heald carrier rails projecting beyond the first holding bolt also constitute a potential source of faults. This is because it is impossible to ensure that each heald carrier rail is located exactly in the transfer path of the respective heald.

OBJECT AND SUMMARY OF THE INVENTION

The present invention provides a transfer apparatus for transferring healds from a distribution system which allows a fault-free automatic transfer of healds having closed end loops.

This object is achieved, according to the invention, in that there are provided in the region of the transfer station, for each carrier rail, a lock having two spaced controlled clamps and a slide for displacing the healds on the carrier rail. The clamps are opened alternately and the transport of the healds through the clamp adjacent to the heald holder takes place by means of the respective transfer member and through the other clamp by means of the slide.

The lock having the controlled clamps makes it possible to fix the carrier rails as near as possible to the heald holder, so that an exact alignment of the end of the carrier rails with the heald holders and therefore a fault-free transfer of the healds is guaranteed.

In a preferred embodiment of the apparatus according to the invention, the heald carrier rails have, in the region of the transfer station, an entry part which is formed by an adaptor rail, which is held by the clamps and which is provided for the intermediate storage of the healds.

The advantage of the adaptor rail is that all types of heald carrier rails can be used without difficulty. This is because the clamps, adaptor rail, heal holders and slides can be coordinated with one another in the best possible way in the transfer station, irrespective of the type of heald carrier rail just used, and only the connection between the adaptor rail and heald carrier rail needs to be adapted to the latter.

BRIEF DESCRIPTION OF THE DRAWING FIGURES

The invention is explained in more detail below by reference to the accompanying drawing figures in which like elements bear like reference numerals and wherein.

DETAILED DESCRIPTION OF THE PREFERRED EMBODIMENTS

Figure 1:
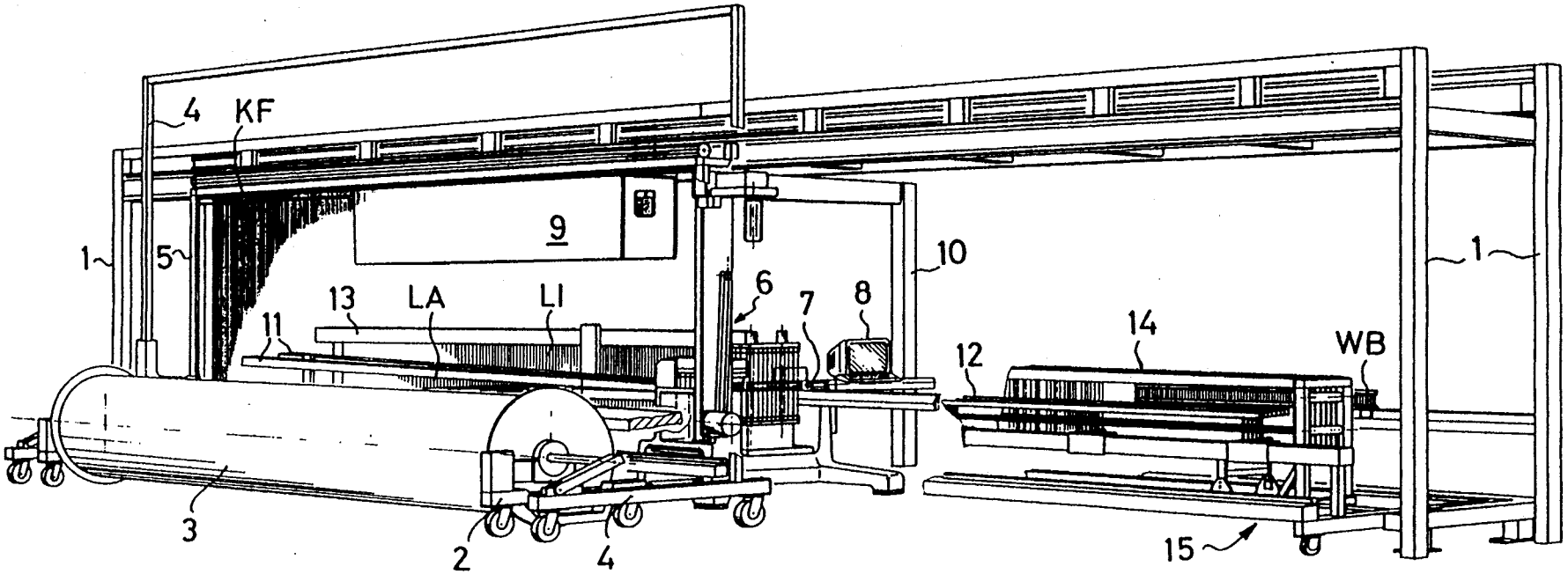
FIG. 1 is a general perspective view of a warp-thread drawing-in machine.

According to FIG. 1, the drawing-in machine consists of a basic stand 1 and various subassemblies which are arranged in the stand and which each form an operating module. A warp-beam carriage 2 having arranged thereon a warp beam 3 is positioned in front of the basic stand 1. Moreover, the warp-beam carriage 2 contains a lifting device 4 for the mounting of a thread frame 5, on which the warp threads KF are tentered. This tentering takes place before the actual drawing-in and at a location separate from the drawing-in machine, the thread frame 5 being positioned, at the lower end of the lifting device 4, in the immediate vicinity of the warp beam 3. For the drawing-in operation, the warp-beam carriage 2 together with the warp beam 3 and lifting device 4 is moved up to the so-called setting-up side of the drawing-in machine, and the thread frame 5 is lifted upwards by the lifting device 4 and suspended in the basic stand 1, where it then assumes the position shown.

The thread frame 5 is displaceable in the longitudinal direction of the basic stand 1 by means of a drive (not shown). During this displacement, the warp threads KF are guided past a thread-separating group 6 forming part of a so-called yarn module and are at the same time separated and divided off. After being divided off, the warp threads KF are cut off and presented to a drawing-in needle 7 which forms an integral part of the so-called draw-in module. To divide off the warp threads, the dividing-off device used in the warp-tying machine USTER TOPMATIC can be employed as an example.

Next to the drawing-in needle 7 is a video-display unit 8 which belongs to an operating station and which serves for indicating machine functions and machine malfunctions, and for inputting data input. The operating station, which forms part of a so-called programming module, also contains an input stage for the manual input of particular functions, such as, for example, crawling speed, start/stop, repetition of operations, and the like. The control of the drawing-in machine takes place by means of a control module which contains a control computer and which is arranged in a control box 9. In addition to the control computer, this control box contains a module computer for each so-called main module, the individual module computers being controlled and monitored by the control computer. The main modules of the drawing-in machine are, in addition to the modules already mentioned (i.e., the draw-in module, yarn module, control module and programming module), the heald module, the drop-wire module and the reed module.

The thread-separating group 6, which presents to the drawing-in needle 7 the warp threads KF to be drawn in, and the path of movement of the drawing-in needle 7, which runs vertically relative to the plane of the tentered warp threads KF, determine a plane which is located in the region of a pillar 10 forming part of the basic stand and which separates the setting-up side already mentioned from the so-called stripping-off side of the drawing-in machine. On the setting-up side, the warp threads and the individual elements, into which the warp threads are to be drawn, are supplied. On the stripping-off side, the so-called harness (healds, drop-wires and reed) together with the drawn-in warp threads can be extracted. During the drawing-in operation, the thread frame 5 together with the warp threads KF, and the warp-beam carriage 2 together with the warp beam 3 are moved to the right past the thread-separating group 6, with the drawing-in needle 7 extracting from the frame 5 in succession the warp threads KF tentered on the latter.

When all the warp threads KF are drawn in and the thread frame 5 is empty, the frame 5, together with the warp-beam carriage 2, the warp beam 3 and the lifting device 4, is located on the stripping-off side and can be removed from the basic stand 1.

Arranged directly behind the plane of the warp threads KF are the warp-thread stop-motion drop-wires LA, behind these the healds LI and further to the rear the reed. The drop-wires LA are stacked in hand magazines, and the full hand magazines are suspended in the feed rails 11 which are arranged at an inclination and on which they are transported to the right towards the drawing-in needle 7. There, they are separated and brought into the drawing-in position. After the drawing-in has taken place, the drop-wires LA pass onto the stripping-off side on the drop-wire carrier rails 12.

The healds LI are lined up on rails 13 and are manually or automatically displaced to a separating stage. The healds LI are then brought individually into their drawing-in position and, after drawing-in has taken place, are distributed to the corresponding carrier rails 14 on the stripping-off side. The reed is likewise moved in steps past the drawing-in needle 7, the corresponding reed gap being opened for the drawing-in. After the drawing-in, the reed is likewise located on the stripping-off side. Part of the reed WB can be seen on the right next to the carrier rails 14. This representation is to be understood purely as an illustration, because, in the illustrated position of the frame 5, the reed is, of course, located on the setting-up side.

As can also be seen from FIG. 1, there is provided on the stripping-off side a so-called harness carriage 15. This carriage 15, together with the drop-wire carrier rails 12 fastened on it, the carrier rails 14 and a mounting for the reed, is pushed into the basic stand 1 into the position shown and, after the drawing-in, carries the harness together with the drawn-in warp threads KF. At this moment, the warp-beam carriage 2 together with the warp beam 3 is located directly in front of the harness carriage 15. The harness is then transferred by means of the lifting device 4 from the harness carriage 15 onto the warp-beam carriage 2 which then carries the warp beam 3 and the drawn-in harness and which can be moved up to the respective weaving machine or into an intermediate storage area.

The functions described are distributed to a plurality of modules which constitute virtually independent machines controlled by the common control computer. The cross-connections between the individual modules run by way of this overriding control computer and there are no direct cross-connections between the individual modules. The already mentioned main modules of the drawing-in machine are themselves again of modular construction and consist, as a rule, of part modules.

Figure 2:
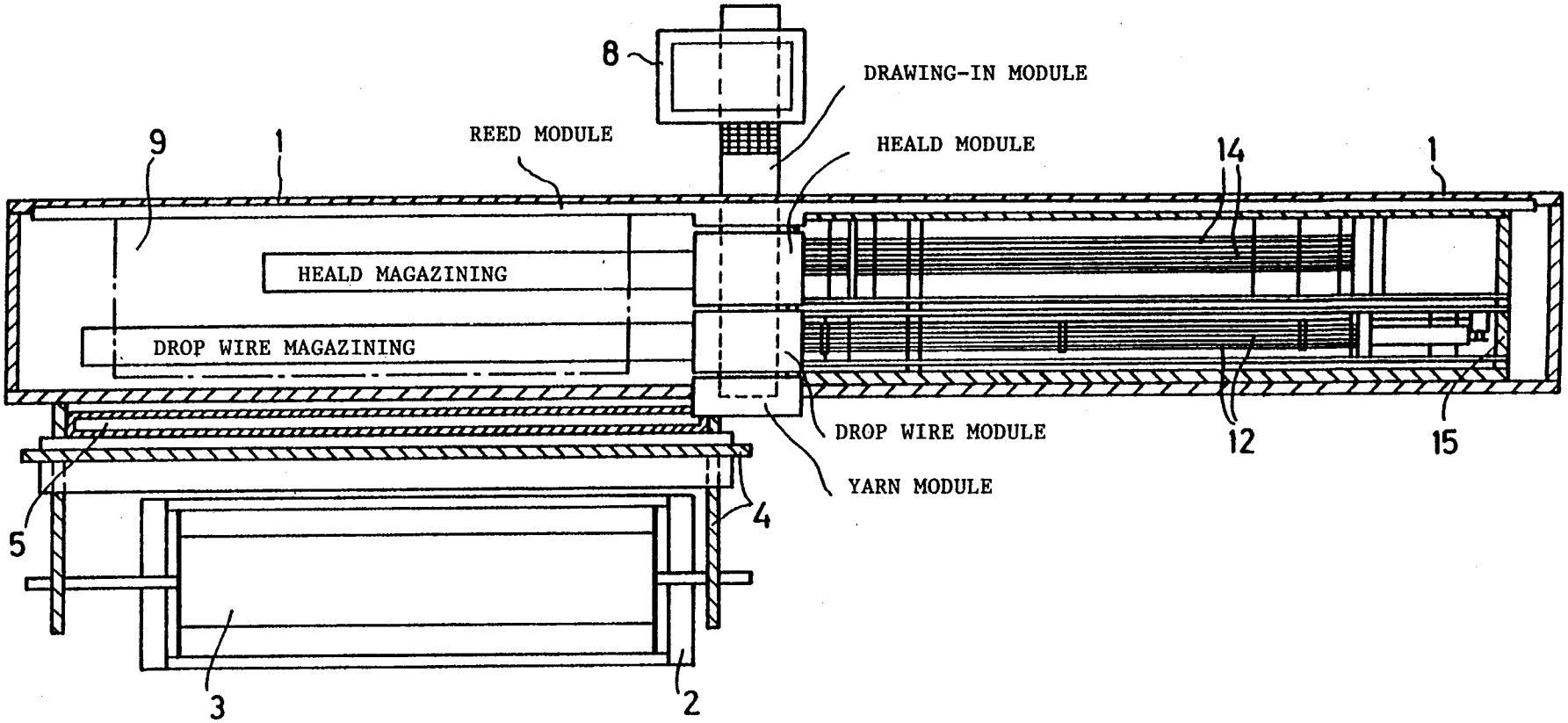
FIG. 2 is a diagrammatic top view of the drawing-in machine of FIG. 1.

This modular construction, which is described in Swiss Application No. 679,871, can be seen especially clearly from the representation of FIG. 2. FIG. 2 shows the basic stand 1, the warp-beam carriage 2 together with the warp beam 3, the lifting device 4 and the thread frame 5, which are coupled together with the warp-beam carriage 2, the yarn module, the drop-wire module, the heald module, the reed module, the operating station with the video display unit 8, the draw-in module, the control box 9, the "heald magazining" part module, the "drop-wire magazining" part module and the harness carriage 15 together with the drop-wire carrier rails 12 and the carrier rails 14 for the healds.

As can be appreciated from CH-A-679,871 the heald module, which works off the healds LI from the magazine stack up to the heald carrying a drawn-in warp thread, on a carrier rail 14, consists of the following part modules:

- Heald magazine: acceptance of the healds by the user from the stack, and transfer of the heald stacks to the "heald separation" part module.
- Heald separation: reception of the heald stacks, separation of the healds from the stack, and transfer of the separated healds to the "heald positioning" part module.
- Heald positioning: take-over of the healds from the "heald separation" part module, transport of the healds to the drawing-in position, lateral and vertical positioning of the healds, transport of the healds together with the drawn-in warp thread to the predetermined carrier-rail position, and transfer of the healds onto the respective carrier rail.

Heald conveyance: conveyance of the healds together with the drawn-in warp threads along the carrier rails from the filling-up side to the other end.

The "heald separation" part module is described, for the working off of healds having open end loops, in U.S. Pat. No. 5,184,380 and, for the working off of healds having closed end loops, in a U.S. patent application filed concurrently herewith and entitled "Heald-Separation Apparatus For Warp-Thread Drawing-In Machines," The "heald positioning" part module is described in European Patent Application No. 0 500 848 (WO-A-92/05303). The portion of the "heald positioning" part module involving the transfer of the healds onto the carrier rails and specifically pertaining to the working off of healds having closed end loops will be described below.

Figure 3:
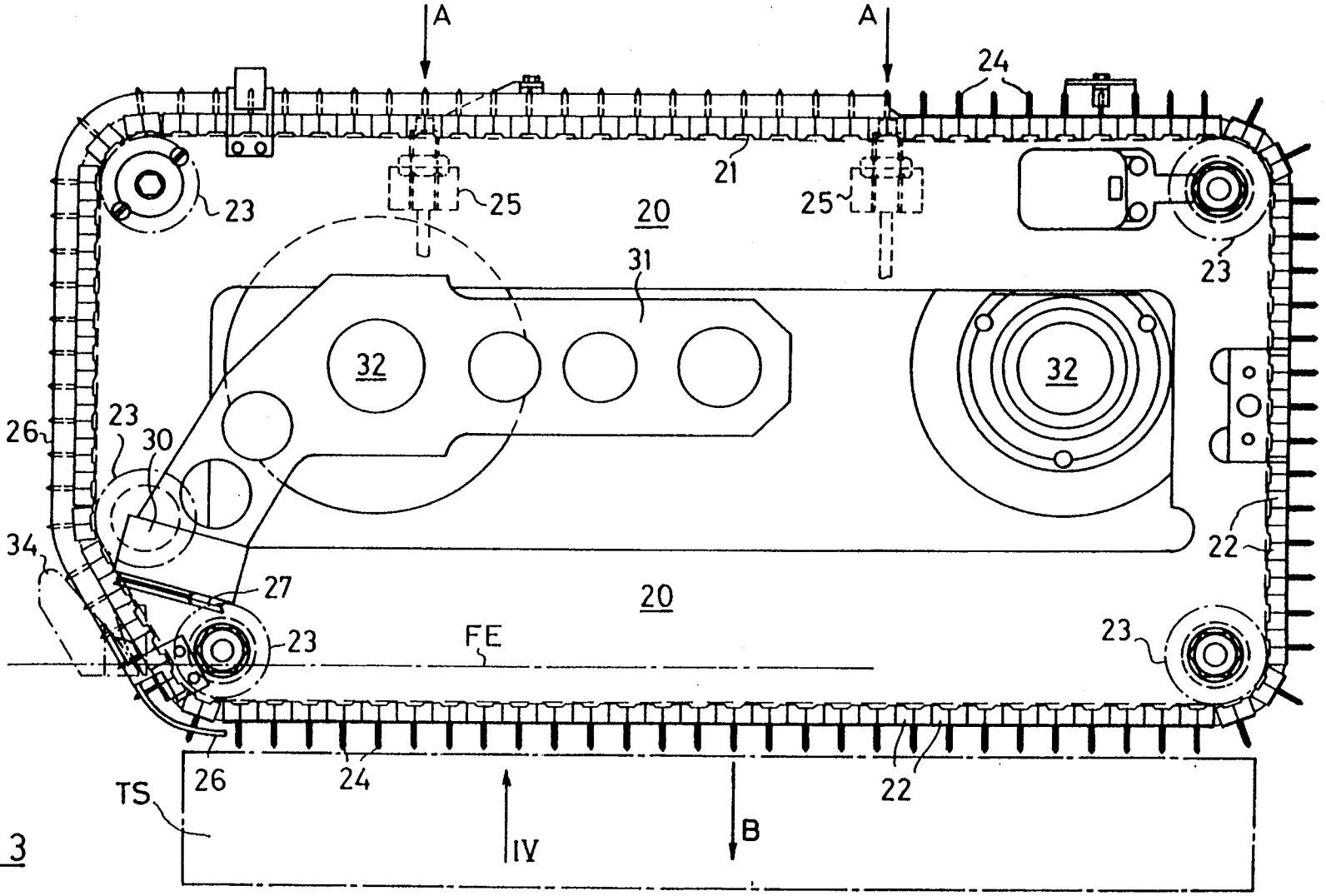
FIG. 3 is a top view of a distribution station for healds.
Figure 4:
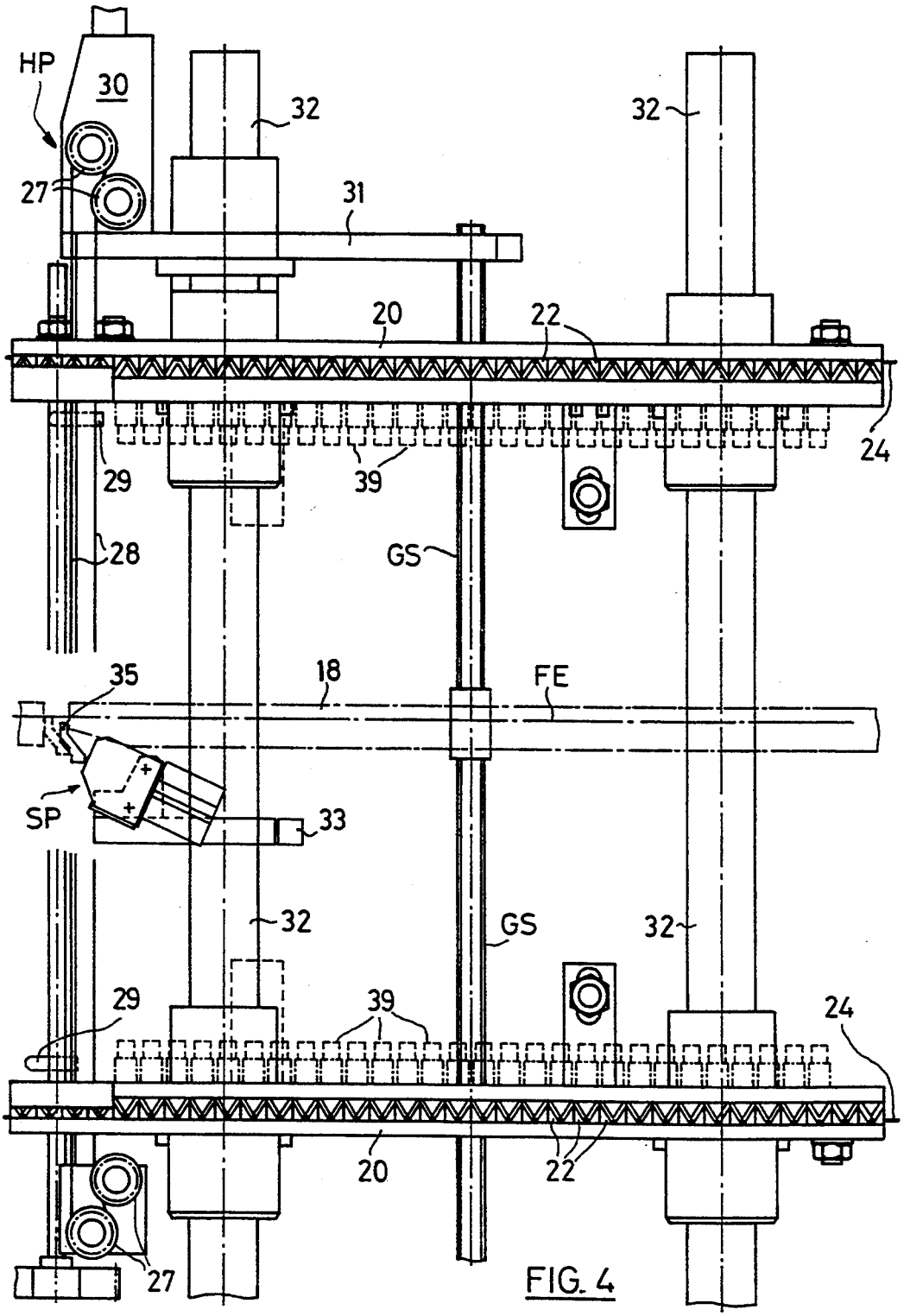
FIG. 4 is a view in the direction of the arrow IV of FIG. 3.

As can be seen from FIGS. 3 and 4, the "heald positioning" part module contains essentially two endless transport means which are provided with heald holders and which are arranged in two transport planes formed by corresponding plates 20. The transport means are a bandlike, belt-like or chain-like design; a chain consisting of individual links 22 carried by a toothed belt 21 is preferably used. The toothed belt 21 is provided on both sides with toothing. The toothing on the inside being in engagement with corresponding guide rollers 23, at least one of which is motor-driven. The toothing on the outside of the toothed belt 21 centers the chain links.

Each of the chain links 22 has, on its side facing away from the toothed belt 21, a projecting V-shaped rib, at the apex of which is anchored a pin 24 designed as a heald holder. The healds are slipped with their end hooks onto the pins 24. The vertical distance between the pins 24 and therefore between the plates 20 is adjustable for adaptation to the length of the healds to be worked off. This purpose is served by a threaded spindle GS which engages threaded locks mounted on the plates 20.

The transfer of the healds onto the "heald positioning" part module takes place at the points designated by arrows A, the two arrows symbolizing that the heald separation and heald transfer take place in two channels, but this is not absolutely necessary. Sensors 25 for monitoring the heald take-over are present at the take-over points. After the take-over, the healds are transported to the thread drawing-in position by the chain 21, 22 rotating in the anticlockwise direction and driven intermittently by a stepping motor.

Provided between the take-over point A and the thread drawing-in position is a guide rail 26 which prevents the healds from falling off the pins 24. In FIGS. 3 and 4, the thread drawing-in path is designated by a dot-and-dash straight line FE, and the thread drawing-in position of the healds is the point of intersection of their path of movement with the straight line FE. The reference numeral 18 denotes a channel-like guide of the drawing-in needle 7 (see, in this respect, WO-A-92/05303 already mentioned).

Since the thread eye of the healds is relatively small, the healds have to be positioned very accurately for the thread drawing-in operation. This fine positioning takes place, on the one hand, vertically (i.e., in the longitudinal direction of the healds) by positioning means HP. The positioning takes place laterally (i.e., transversely to the longitudinal direction and transversely to the thread draw-in path FE) by positioning means SP. The vertical-positioning means HP evident from FIG. 4 comprises an endless rope 28 which is guided via driving rollers 27. Each of the two strands of the rope 28 has a positioning pin 29 fastened thereto. These positioning pins travel upwards and downwards during the actuation of the vertical-positioning means HP and press against the V-shaped ribs of the two chain links 22 carrying the heald to be positioned. The drive for the rope 28, formed by a pneumatic cylinder 30, and the upper driving rollers 27 are mounted on a supporting arm 31 which is itself carried by a carrier shaft 32. Two carrier shafts 32 of this type are provided altogether.

The lateral-positioning means SP is mounted on a carrier 33 likewise fastened to the carrier shaft 32 carrying the supporting arm 31 and comprises, in particular, a transverse guide 34 for the healds and a positioning lever 35 for the exact lateral positioning of these.

Subsequent to the thread drawing-in operation, the heald is released again from the positioning lever 35 so that it can leave the transverse guide 34 and finally also the guide rail 26 and be transferred onto its heald carrier rail. The transfer direction is designated by an arrow B. This transfer takes place by means of pneumatically driven ejection cylinders 39 which are arranged in the region of the two plates 21. The ejection cylinders 39 can be activated selectively, specifically in pairs, in each case the upper and the lower ejection cylinder 39 of each heald, in dependence on the distribution of the healds to the individual heald carrier rails which is predetermined by the pattern to be produced on the weaving machine.

During the working off of healds having open end loops, the carrier rails are fed with the healds, the carrier rails being in their position mounted in the heald frames. The heald frames are therefore mounted on the harness carriage 15 (FIG. 1), the side frame being removed on the feed side. The heald transfer takes place by means of the ejection cylinders 39 directly onto the heald carrier rails mounted in the heald frames.

Figure 5:
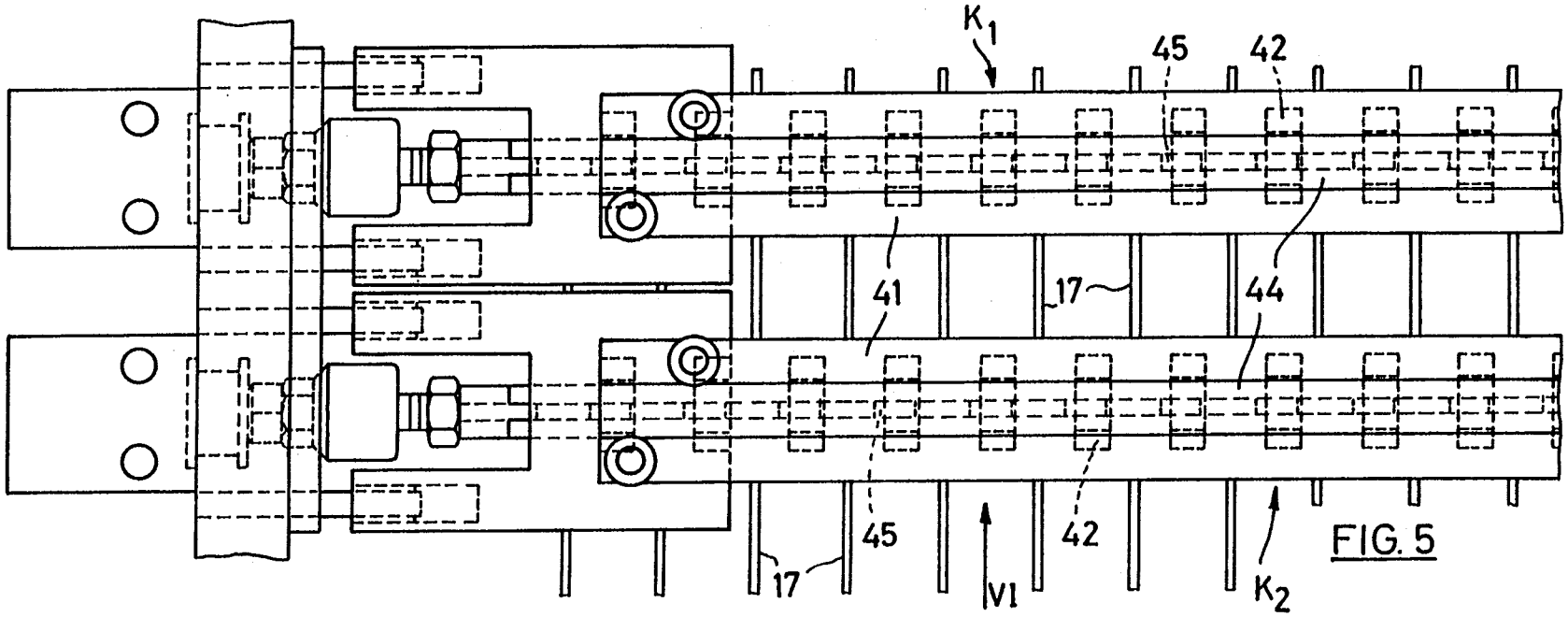
FIG. 5 is a top view of the transfer station of the distribution station of FIG. 3.
Figure 6:
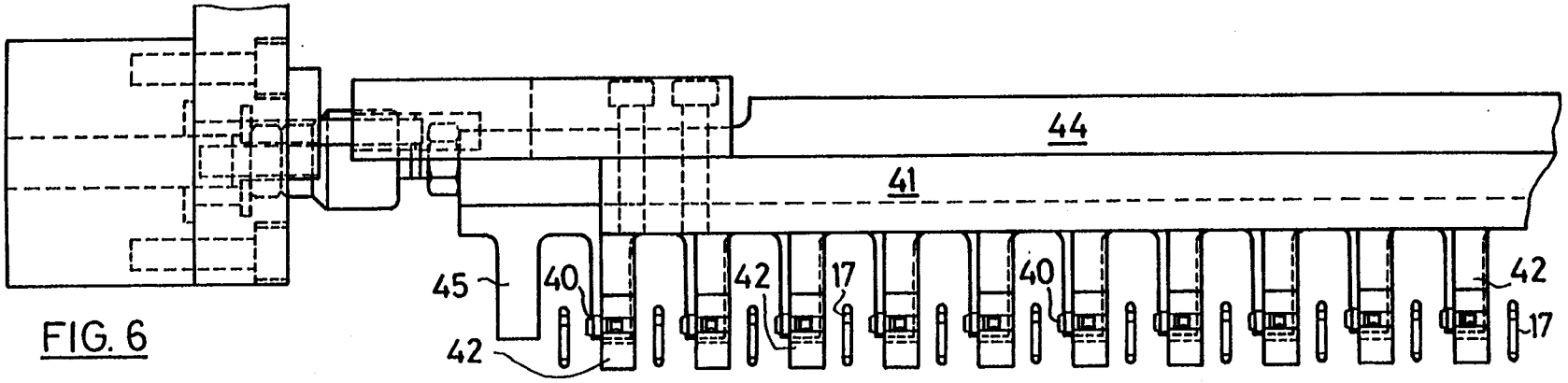
FIG. 6 is a view in the direction of the arrow VI of FIG. 5.

During the working off of healds having closed end loops, the conditions are more complicated because here, the heald carrier rails are arranged without heald frames on the harness carriage and special means for positioning the heald carrier rails and for allowing the displacement of the healds surrounding the carrier rails on all sides by means of their closed end loops are required. These means are designated below as the transfer station TS. The transfer station TS is indicated diagrammatically in FIG. 3 and will now be explained in more detail with reference to FIGS. 5 to 8. FIG. 5 shows a top view of an essential component of the transfer station, FIG. 6 shows a front view in the direction of the arrow VI of FIG. 5, FIG. 7 shows a side view from the left and FIG. 8 shows a detail of FIG. 7.

Figure 7:
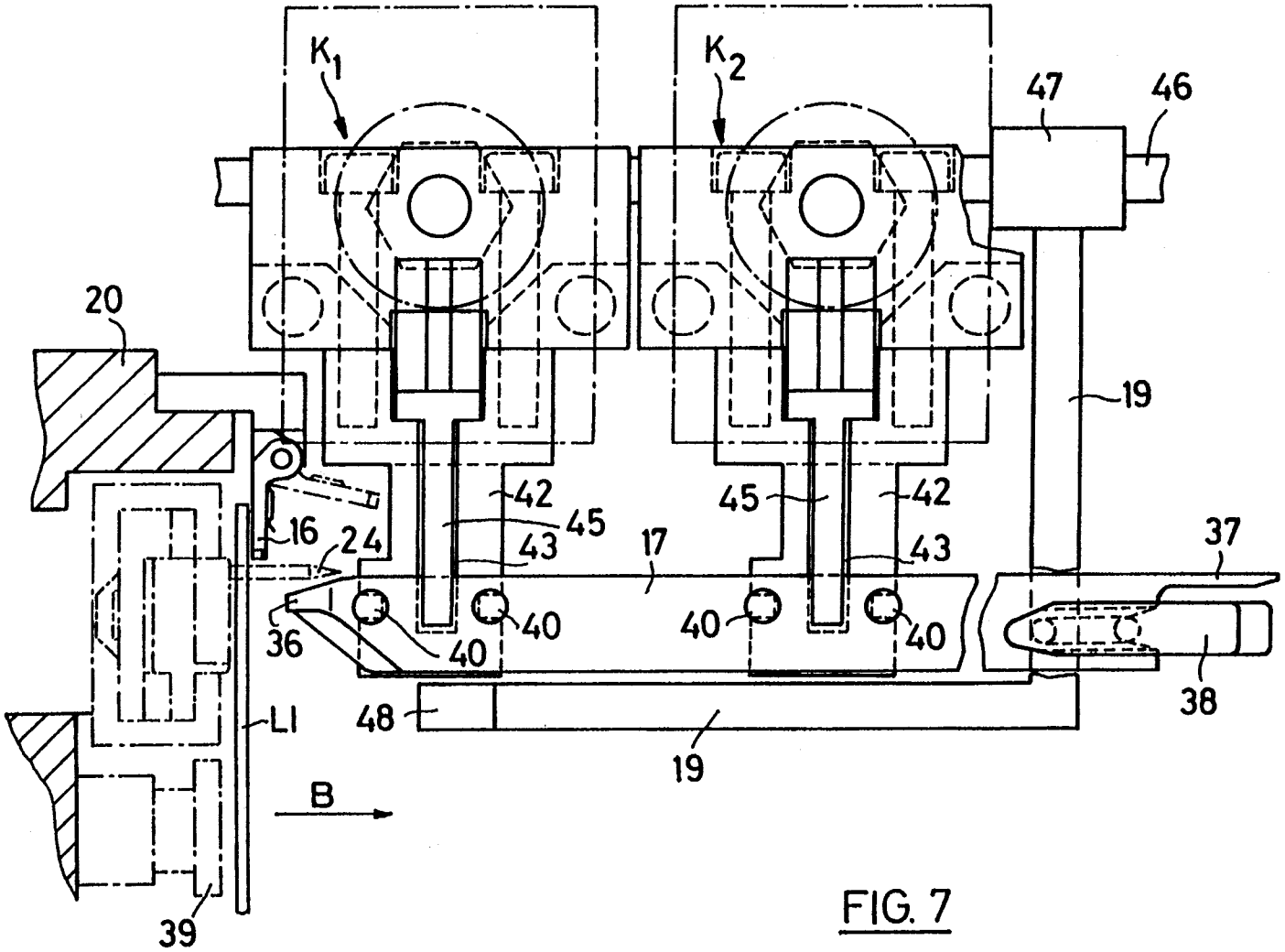
FIG. 7 is a view of the transfer station, as seen from the left in relation to FIG. 6.
Figure 8:
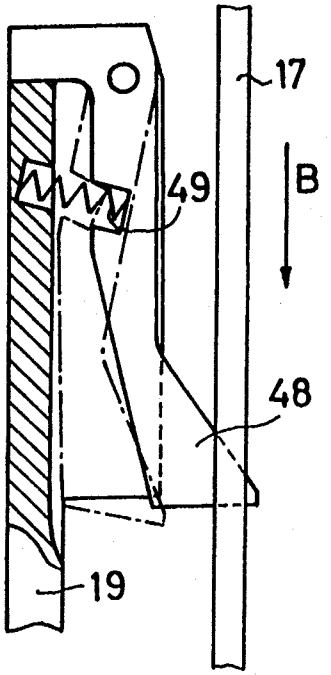
FIG. 8 is a detail of FIG. 7.

As is evident particularly from FIG. 7, the transfer station TS is arranged in the immediate vicinity of the ejection cylinders 39, the latter forming part of the transfer station. The healds LI, in this region where they have left the guide rails 26, are secured against falling off from the pins 24 by means of resiliently mounted pivoting levers 16. The pivoting levers 16 press the healds LI onto the pins 24 and are pivoted in the anticlockwise direction during the extension of the ejection cylinders 39, so that the healds can be stripped off from the pins 24 in the direction of the arrow B.

The transfer station TS contains, in addition to the ejection cylinders 39, a lock having two controlled clamps $K_1$ and $K_2$, adaptor rails 17 held by the clamps, and slides 19 for conveying the healds on the adaptor rails 17 through the lock. The adaptor rails 17, which serve for the guidance, mounting and intermediate storage of the healds stripped off from the pins 24, are so optimized in shape that the take-over of the healds can take place without difficulty. As illustrated, the adaptor rails 17, at their entry end on the left in FIG. 7, terminate in a slightly downwardly inclined nose 36 which overlaps with the tips of the pins 24. The top edge of the nose 36 is located just below the plane of the pins 24. The heald LI stripped off from its pin 24 can thereby slide easily onto the adaptor rail 17.

The exit end of the adaptor rail 17 on the right in FIG. 7 has a stepped portion, the top edge of the adaptor rail terminating in a web 37 projecting beyond this stepped portion. Positioned into the stepped portion is a transitional spring 38, by means of which the adaptor rail 17 is connected to the heald carrier rail 14 (FIGS. 1 and 2). The transitional spring 38, which makes the connection between the adaptor rail 17 and heald carrier rail 14 and which guides the heald carrier rail 14 laterally, is designed as an exchangeable part which, in the event of a fault, can be exchanged by hand without a tool. Moreover, the adaptor rail 17 also has two pairs of centering bores which are provided for the engagement of positioning bolts 40 of the two clamps $K_1$ and $K_2$.

The two clamps $K_1$ and $K_2$ are identical in design and each consists of a stop block 41 having a plurality of essentially rectangular flat stop teeth 42, and a clamping rake 44 guided in a slot-like recess 43 of the stop teeth 42 and having clamping teeth 45. Inserted into each stop tooth 42 are two positioning bolts 40 which are provided for engagement into the centering bores of the adaptor rails 17.

The stop block 41 serves for positioning the adaptor rails 17 relative to the pins 24, with the stop teeth 42 positioning the adaptor rails 17 laterally and the positioning bolts 40 positioning the adaptor rails 17 vertically, in the longitudinal direction of the healds and in the longitudinal direction of the rails. The clamping rake 44 serves for fixing the adaptor rails 17 in the position.

The stop block 41 and the clamping rake 44 run in one another in opposite directions, the drive taking place by means of electropneumatically activated pneumatic cylinders. FIGS. 5 and 6 show the lock on the upper plate 20 (FIG. 4) in the open state, in which the two clamps $K_1$ and $K_2$ are open. This state, which was chosen for the sake of greater clarity, does not occur during practical operation, because only one of the two clamps $K_1$ or $K_2$ can ever be opened. An identical lock is arranged on the lower plate 20 in mirror symmetry to the lock shown.

To close the open lock illustrated in FIGS. 5 and 6, the stop block 41 is moved to the left until the positioning bolts 40 penetrate into the centering bores of the adaptor rails 17 and the stop teeth 42 butt against the adaptor rails 17. At the same time, the clamping rake 44 is moved to the right until the clamping teeth 45 strike the adaptor rails 17 and clamp these firmly against the stop teeth 42.

The stroke of the ejection cylinders 39 is such that in each case they push the heald LI to be transferred into the space between the first clamp $K_1$, and the second clamp $K_2$. This means that, for the heald transfer, in each case the first clamp $K_1$ is open and the second clamp $K_2$ is closed. The further transport of the healds through the second clamp $K_2$ as far as the heald carrier rail takes place by means of the slides 19 already mentioned, which additionally serve as retaining devices for the already transferred healds located in the space between the two clamps and which secure these healds against sliding back through the open first clamp $K_1$.

According to FIG. 7, arranged after the second clamp $K_2$ in the direction of transport B of the healds, parallel to the stop block 41, is a slide carriage 47 which is pneumatically displaceable on guides 46 oriented parallel to the adaptor rails 17 and which carries a downwardly projecting L-shaped slide 19 for each adaptor rail 17. The slide 19, particularly its horizontal leg, extends parallel to the associated adaptor rail 17 at a slight lateral distance from the latter (see FIG. 8).

According to FIG. 8, there is mounted pivotally in the horizontal leg of the slide 19 a sawtooth-shaped flap 48. This flap 48 is pressed away from the leg by a spring 49 into the normal position, represented by unbroken lines, in which the tip of the flap 48 projects into the plane of the adaptor rail 17. In this position, the steeper flank of the sawtooth-shaped flap 48, the said flank acting as a slide edge, is transverse to the adaptor rail 17 and, in the event of a movement of the slide 19 in the direction of the arrow B, would take up and displace the healds lined up on the adaptor rail 17 in front of the flap 48 in the direction of movement. On the other hand, when a heald is pushed onto the adaptor rail 17 in the direction of the arrow B by the ejection cylinder 39 (FIG. 7), this heald presses the flap 48 against the slide 19 and can pass the flap. After the heald has passed, the flap is pivoted back into its normal position by the spring 49 and, in this position, secures the heald against an inadvertent backward movement.

The distance between the two clamps $K_1$ and $K_2$ amounts to approximately 25 millimeters, so that a relatively large number of approximately 20 healds can be intermediately stored in the space between the clamps. The operating cycle of the transfer station TS (FIG. 3) is as follows.

In the normal operating state, in which healds are being distributed continuously into the transfer station, the clamp $K_1$ is open and the clamp $K_2$ closed, so that the ejection cylinders can distribute healds to the adaptor rails 17 for intermediate storage. In this operating stage, the slides 19 are retracted, that is to say they assume the passive position, shown in FIG. 7, in which they secure the intermediately stored healds against a backward movement through the clamp $K_1$.

As soon as the number of healds intermediately stored on an adaptor rail 17 reaches a specific value, the clamps are changed over, that is to say the clamp $K_1$ is closed and the clamp $K_2$ is opened. Two cases are possible here.

1. The number of healds intermediately stored on any adaptor rail is between 5 and 10, and no heald transfer or heald distribution is provided for the next cycle. In this case, the clamps are changed over and the other modules of the drawing-in machine continue to run normally.

2. The number of healds intermediately stored on any adaptor rail is 10, and a new distribution is provided for the next cycle. Then, on the one hand, an idle stroke of the drawing-in machine during which no distribution and no drawing-in take place is executed, and, on the other hand, the clamps are changed over.

During the change-over of the clamps, first the clamp $K_1$ is closed, then the clamp $K_2$ is opened and the slide 19 is extended and executes a transport stroke in the direction of the arrow B, during which the intermediately stored healds are displaced through the clamp $K_2$ to the heald carrier rail.

After the passage of the healds through the clamp $K_2$ has taken place, the clamp $K_2$ is closed, then the clamp $K_1$ is opened and then the slide 19 is retracted into its retaining position. After the conclusion of these steps, a new heald distribution is possible.

The determination of the number of healds intermediately stored on the adaptor rails is carried out in the module computer of the heald module by means of the working strokes of the individual ejection cylinders 39. When the clamp change-over according to case 2 takes place, during which an idle stroke of the drawing-in machine has to be initiated, then the module computer of the heald module supplies a corresponding signal to the control computer which itself activates correspondingly the module computers of the respective modules, particularly of the draw-in module.

The mounting of the heald carrier rails 14 in the harness carriage 15 can take place, in principle, by means of an apparatus of the type described in European Patent Application No. 0 496 232 for the handling of drop-wires. Preferably, however, the mounting takes place in a similar way to the drawing-in system designated USTER EMU by means of holding bolts which are respectively removed temporarily for the passage of a stack of a plurality of healds. When the distance between these holding bolts is selected to be sufficiently large, the time interval between the individual manipulations to be carried out by hand is also so large that the pulling out and pushing in again of the holding bolts can be carried out easily by a single operator.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Apparatus for the selective transfer of healds from a heald holder which forms a part of a distribution station of a warp-thread drawing-in machine to heald carrier rails, comprising a transfer station that includes transfer members past which the heald holder is guided for moving healds from the heald holder onto the heald carrier rail, a lock positioned adjacent the transfer station for each carrier rail, a slide for each carrier rail to displace the healds on the carrier rail, each lock having two spaced controlled clamps which open and close alternately with respect to one another, one of the clamps being positioned closer to the heald holder than the other clamp, the healds being transported through the one clamp by way of the respective transfer member and being transported through the other clamp by way of the slide to thereby transfer the healds to the heald carrier rail.

2. Apparatus according to claim 1, wherein the heald carrier rails each have an entry part adjacent the transfer station which is formed by an adaptor rail, the adapter rail being held by the clamps and being provided for the intermediate storage of the healds.

3. Apparatus according to claim 2, wherein the two clamps of each lock are jointly actuable for a plurality of adaptor rails.

4. Apparatus according to claim 3, wherein each of the clamps includes a stop block and a clamping rake which are both arranged transversely to the adaptor rails and connected to a common drive.

5. Apparatus according to claim 4, wherein the stop block and the clamping rake move relative to one another and are driven in opposite directions.

6. Apparatus according to claim 5, wherein the stop block has a stop tooth for each adaptor rail and the clamping rake has a plurality of clamping teeth equal in number to the number of adaptor rails.

7. Apparatus according to claim 6, wherein the stop teeth have a flat shape, the clamping rakes being guided in recesses in the stop teeth.

8. Apparatus according to claim 7, wherein the stop teeth have positioning bolts which engage corresponding centering bores provided in the adaptor rails.

9. Apparatus according to claim 8, wherein the adaptor rails have an entry end adjacent the heald holders which terminates in a nose positioned under the tips of the heald holders.

10. Apparatus according to claim 9, wherein the adaptor rails have an exit end opposite the entry end and a top edge, the adaptor rails having a stepped portion at the exit end and terminating at the top edge in a web which projects beyond the stepped portion and which engages over the connected heald carrier rail.

11. Apparatus according to claim 10, wherein the heald carrier rails are connected to the adaptor rails by means of a transitional spring positioned adjacent the said stepped portion.

12. Apparatus according to claim 11, wherein the transitional spring is manually exchangeable.

13. Apparatus according to claim 8, wherein the slides comprise elongated fingers which are driven by a common slide carriage.

14. Apparatus according to claim 13, wherein the slides have a leg extending parallel to the adaptor rails, and including a pivotable flap mounted resiliently on said leg.

15. Apparatus according to claim 14, wherein the pivotable flap is movable along the adaptor rails to move the healds in a direction of transport, said pivotable flap also securing the healds against displacement in a direction opposite said transport direction.

16. Apparatus according to claim 8, wherein during a normal operation of the drawing-in machine with a continuous distribution of the healds to the carrier rails, the one clamp is opened and the other clamp is closed.

17. Apparatus according to claim 16, wherein the clamps move between the open and closed position based on the number of healds intermediately stored on the adaptor rails.

* * * * *